US008399166B2

(12) United States Patent
Kouyama et al.

(10) Patent No.: US 8,399,166 B2
(45) Date of Patent: Mar. 19, 2013

(54) TONER FOR DEVELOPING ELECTROSTATIC IMAGE, FULL COLOR TONER KIT, AND IMAGE FORMATION METHOD

(75) Inventors: Mikio Kouyama, Tokyo (JP); Hiroshi Yamazaki, Tokyo (JP); Ken Ohmura, Tokyo (JP); Kenji Hayashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 511 days.

(21) Appl. No.: 12/407,887

(22) Filed: Mar. 20, 2009

(65) Prior Publication Data

US 2009/0239168 A1 Sep. 24, 2009

(30) Foreign Application Priority Data

Mar. 24, 2008 (JP) ..... 2008-075468

(51) Int. Cl.
*G03G 9/09* (2006.01)

(52) U.S. Cl. ..... 430/107.1; 430/108.1; 430/109.4

(58) Field of Classification Search ..... 430/107.1, 430/108.1, 109.4
See application file for complete search history.

(56) References Cited

U.S. PATENT DOCUMENTS

| | | | | |
|---|---|---|---|---|
| 2002/0037469 | A1* | 3/2002 | Kohyama et al. | 430/110.3 |
| 2005/0175921 | A1* | 8/2005 | Morris et al. | 430/109.3 |
| 2006/0046178 | A1* | 3/2006 | Akiyama et al. | 430/108.23 |
| 2006/0172211 | A1* | 8/2006 | Ueda et al. | 430/108.4 |
| 2006/0216624 | A1* | 9/2006 | Ueda et al. | 430/108.4 |
| 2007/0020549 | A1* | 1/2007 | Koyama et al. | 430/109.3 |
| 2008/0070147 | A1* | 3/2008 | Uchino et al. | 430/111.1 |
| 2008/0160436 | A1* | 7/2008 | Yamazaki et al. | 430/48 |
| 2008/0233507 | A1* | 9/2008 | Yamazaki et al. | 430/109.3 |

FOREIGN PATENT DOCUMENTS

| | | |
|---|---|---|
| JP | 2005-157314 | 6/2005 |
| JP | 2006-154363 | 6/2006 |
| JP | 2006-267741 | 10/2006 |
| JP | 2007-286148 | 11/2007 |

OTHER PUBLICATIONS

Machine English langauge translation of JP 2006-267741, Oct. 2006.*

* cited by examiner

*Primary Examiner* — Hoa V Le
(74) *Attorney, Agent, or Firm* — Lucas & Mercanti, LLP

(57) ABSTRACT

Disclosed are a toner for developing an electrostatic image, a full color toner kit and an image formation method layer, the toner comprising at least a resin and a colorant, wherein the colorant includes quinacridone pigment having a number average primary particle size of from 30 to 150 nm and having a ratio of a long axis length to a short axis length of from 1.0 to 2.0.

10 Claims, 1 Drawing Sheet

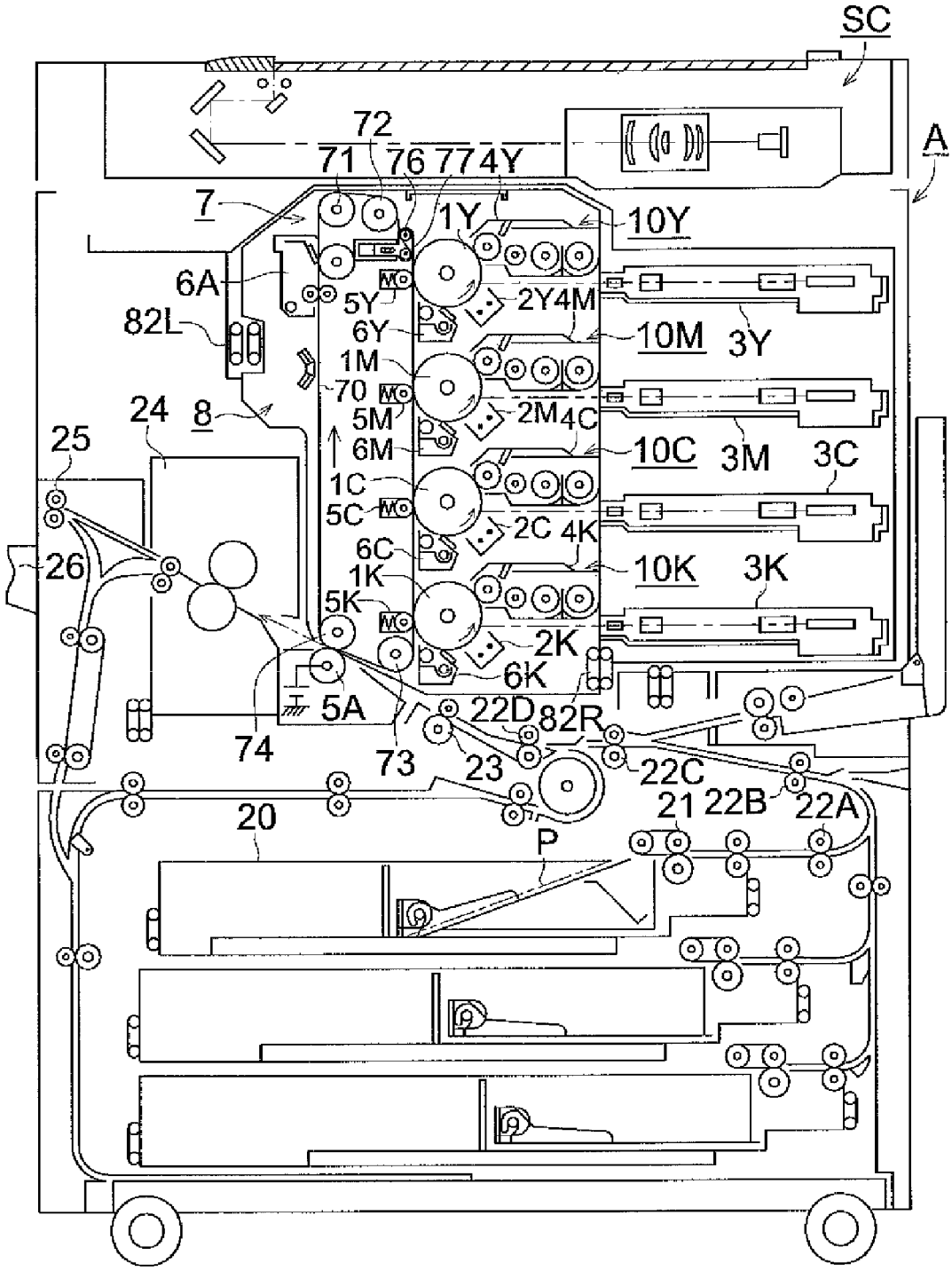
SC
A
72
71
76
77
4Y
7
1Y
10Y
6A
5Y
2Y
4M
82L
6Y
10M
3Y
1M
70
5M
2M
4C
24
8
6M
10C
3M
3C
25
1C
5C
2C
4K
6C
26
1K
10K
3K
5K
2K
6K
5A
22D
82R
74
73
23
22C
21
22B
22A
20
P

TONER FOR DEVELOPING ELECTROSTATIC IMAGE, FULL COLOR TONER KIT, AND IMAGE FORMATION METHOD

This application is based on Japanese Patent Application No 2008-07546B, filed on Mar. 24, 2008 in Japanese Patent Office, the entire content of which is hereby incorporated by reference.

FIELD OF THE INVENTION

The present invention relates to a toner for developing an electrostatic image for use in electrophotographic image formation, and particularly to a toner for developing an electrostatic image comprising, as a colorant, quinacridone pigment having a specific particle size and a specific shape.

BACKGROUND OF THE INVENTION

Recently, electrophotographic image formation using an electrostatic image developing toner (hereinafter also denoted simply as toner) has been applicable to full-color prints as well as monochromatic prints as typified in conventional documentation. As such a full-color image forming apparatus can make printed sheets by the number as required on demand without printing plates, which are required in conventional printing, it has been employed mainly in a short-run printing field in which a small number of prints are often ordered (see for example, Japanese Patent O.P.I. Publication No. 2005-157314).

When making a full-color print used for catalogues or printed advertisements by using a toner, the toner is required to provide color reproduction so as to be faithful to an original image. In full-color image formation, yellow, magenta and cyan toner images are superimposed to reproduce a targeted color image and a color toner as a base is required to have superior color reproducibility in obtaining faithful color reproduction. Particularly in the catalogues or printed advertisements including a portrait image, a high chroma toner, which is capable of reproducing a color tone such as flesh tone faithfully, is required.

Particularly in recent years, opportunities have been increased which outputs a graphic image formed on a display employing a computer. The color gamut of an image formed according to a conventional color-printing method or a conventional color electro-photographic method is far narrower than that of an image formed on a display, and therefore, it is difficult to output an image on the display on a paper to reproduce the color tone of the image as it is. Particularly, reproduction of a so-called secondary color, which is derived from superposition of the color toners, is difficult. In view of the above, study to increase the color gamut of the toner has been made in order to output on a paper an image with color gamut close to that of an image on a display.

Accordingly, study on various colorants has been made in order to achieve increased color gamut or enhanced color reproducibility of color toners. A colorant for a magenta color toner has been studied. As one of typical examples for a magenta toner, there is quinacridone pigment. A toner using quinacridone pigment is generally used, since it exhibits superior light fastness and has an appropriate color tone as a magenta color. However, the toner using quinacridone pigment, when used in combination with other color toners, is likely to produce color contamination, and is difficult to obtain a satisfactory color tone when a high chroma image on a display or computer graphics are output in which high requirements for color tone are made.

Attempts have been made in which quinacridone pigment is not used alone, but used in combination with a dye, whereby chroma is improved (see Japanese Patent O.P.I. Publication No. 2007-286148). Further, attempts have been made in which quinacridone pigment is used in combination with other pigments such as naphthol pigment (see Japanese Patent O.P.I. Publication No. 2006-267741) or anthraquinone pigments (see Japanese Patent O.P.I. Publication No 2006-154363).

However, these techniques are difficult to obtain high light fastness which quinacridone pigment inherently has or to stably maintain color tone for a long term. The toner employing quiuacridone pigment as a colorant has problems in that it is difficult to reproduce the color tone of an image on the display as it is, and to obtain an image with high chroma and high light fastness maintained for a long time.

SUMMARY OF THE INVENTION

An object of the invention is to provide a toner for developing an electrostatic image, which forms a full color image having high chroma and bright color tone, without color contamination, and which has excellent light fastness. Another object of the invention is to provide a toner for developing an electrostatic image capable of fitting its hue angle to color reproduction of a photographic image and of forming a secondary image with high chroma.

The toner for developing an electrostatic image of the invention (hereinafter also referred to as the toner of the invention) comprises at least a resin and a colorant, wherein the colorant includes quinacridone pigment (hereinafter also referred to as the quinacridone pigment in the invention) having a number average primary particle size of from 30 to 150 nm and having a ratio of a long axis length to a short axis length of from 1.0 to 2.0.

BRIEF EXPLANATION OF THE DRAWING

FIG. 1 is a schematic view of one example of a tandem full color image formation apparatus capable of forming an image employing a two-component developer.

DETAILED DESCRIPTION OF THE INVENTION

The above object of the invention can be attained by any one of the following constitutions.

1. A toner for developing an electrostatic image comprising at least a resin and a colorant, wherein the colorant includes quinacridone pigment having a number average primary particle size of from 30 to 150 nm and having a ratio of a long axis length to a short axis length of from 1.0 to 2.0.

2. The toner for developing an electrostatic image of item 1 above, wherein the toner has a volume-based median diameter of from 3 to 8 μm.

3. The toner for developing an electrostatic image of item 1 or 2 above, wherein the toner has a coefficient of variation of from 2 to 21% in the volume-based particle size distribution.

4. The toner for developing an electrostatic image of any one of items 1 through 3 above, wherein the toner has a softening point (Tsp) of from 70 to 110° C.

5. The toner for developing an electrostatic image of any one of items I through 4 above, wherein the content of the quinacridone pigment in the toner is from 1 to 10 weight %.

6. The toner for developing an electrostatic image of any one of items 1 through 5 above, wherein the resin is a polymer having in the side chain a carboxyl group, a sulfonic acid group or a phosphoric acid group.

7. The toner for developing an electrostatic image of any one of items 1 through 6 above, wherein the content of the resin in the toner is from 60 to 95 weight %.

8. A full color toner kit comprised of at least a yellow toner comprising at least a yellow colorant and a resin, a magenta toner comprising at least a magenta colorant and a resin, a cyan toner comprising at least a cyan colorant and a resin, and a black toner comprising at least a black colorant and a resin, wherein the magenta colorant includes quinacridone pigment having a number average primary particle size of from 30 to 150 nm and having a ratio of a long axis length to a short axis length of from 1.0 to 2.0.

9. An image formation method comprising the step of forming an image employing a yellow toner comprising at least a yellow colorant and a resin, a magenta toner comprising at least a magenta colorant and a resin, a cyan toner comprising at least a cyan colorant and a resin, and a black toner comprising at least a black colorant and a resin, wherein the magenta colorant includes quinacridone pigment having a number average primary particle size of from 30 to 150 nm and having a ratio of a long axis length to a short axis length of from 1.0 to 2.0.

The toner of the invention provides a full color image without color contamination and with high chroma in which color reproduction range is increased as compared with a conventional full color toner. Further, the toner image formed employing the toner of the invention provides stable light fastness for a long term.

The toner of the invention provides a monochromatic image without color contamination and with excellent tint, and therefore, a secondary image formed employing the toner of the invention has a bright color tone.

The toner of the invention with excellent tint is a toner capable of fitting its hue angle to color reproduction of a photographic image.

The present invention relates to a toner for developing an electrostatic image comprising at least a resin and a colorant, and particular to a toner for developing an electrostatic image employing a specific colorant, which faithfully reproduces a color tone of a photographic image or an image formed on a display on a paper and provides stable light fastness.

The present inventors have found that a toner, comprising quinacridone pigment having a specific particle size and a specific crystalline state, provides increased color gamut. The color gamut of a toner can be increased only by reducing a colorant particle size to improve dispersibility of the colorant in the toner. However, only the reduction of the colorant particles is difficult to secure both high light fastness and increased color gamut. The present inventors have found that both high light fastness and increased color gamut are obtained by controlling the shape of the colorant particles as well as the particle size of the colorant particles, and completed the invention.

The quinacridone pigment used in the invention has a number average primary particle size of from 30 to 150 nm and has a ratio of a long axis length to a short axis length of from 1.0 to 2.0. Quinacridone pigment having a number average primary particle size less than 30 nm lowers light fastness of the pigment, which does not exhibit the effects of the invention. On the other hand, quinacridone pigment having a number average primary particle size exceeding 150 nm is likely to produce color contamination, and is difficult to obtain increased color gamut. Thus, it has been found that quinacridone pigment having a number average primary particle size of from 30 to 150 nm exhibits the effects of the invention. Quinacridone pigment having a number average primary particle size of from 30 to 100 nm exhibits the effects of the invention more effectively.

The quinacridone pigment in the invention has a ratio of a long axis length to a short axis length of from 1.0 to 2.0. It has been found that quinacridone pigment having a ratio of a long axis length to a short axis length exceeding 2.0, which has a more acicular structure, produces color contamination and tends to lower light fastness. The reason that the quinacridone pigment having a ratio of a long axis length to a short axis length exceeding 2.0 is likely to produce color contamination is unclear, but it is supposed that acicular pigments, if the particle size of the pigments is small and the pigments are well dispersed in the toner particles, are likely to superimpose each other in the toner particles, resulting in color contamination. It is supposed that the pigment particles having an acicular form are likely to produce structure defects within the particles, resulting in light deterioration and in lowering of light fastness.

In view of the above, it is considered that the pigment having a ratio of a long axis length to a short axis length of from 1.0 to 2.0, which is approximately in the spherical form and has a structure with less protrusions, improves the dispersibility in the toner particles, whereby both increased color gamut and high light fastness are obtained.

The quinacridone pigment has a crystalline structure in which the quinacridone molecule skeletons of a plane structure are superimposed in the direction perpendicular to the molecular plane through hydrogen bonding due to the carbonyl group and the amino group so that the planes face each other. Accordingly, acicular particles having a large long-to-short axis length ratio are considered to be ones having higher crystallinity. Judging from the molecular skeleton of quinacridone, the direction perpendicular to the molecular plane shows aromaticity and high hydrophobic property, and the direction parallel with the molecular plane shows extremely low hydrophobic property due to the presence of the carbonyl group and the amino group, and as a result, it is supposed that it shows low hydrophobic property as compared with the direction perpendicular to the molecular plane. Accordingly, in order to improve dispersion of the quinacridone pigment in a resin, it is important to increase this hydrophobic property. The pigment having a low ratio of a long axis length to a short axis length has a hydrophobic surface area larger than pigment having a high ratio of a long axis length to a short axis length and has a high affinity to a resin used in the toner, and as a result, it is supposed that the dispersibility is improved and the color gamut can be increased. Further, it is supposed that in the pigment whose affinity to a resin is increased, the pigment site subjected to light deterioration is covered with the resin, resulting in improved light fastness.

The quinacridone pigment in the invention is not specifically limited as far as it has the characteristics as described above. Typical examples of the quinacridone pigment include dimethylquinacridone pigment such as C.I. Pigment Red 122; dichloroquinacridone pigment such as C.I. Pigment Red 202 and C.I. Pigment Red 209; and unsubstituted quinacridone pigment such as C.I. Pigment Violet 19. Of these, C.I. Pigment Red 122 is especially preferred.

A mixture or solid solution composed of two or more kinds of the pigments as described above exhibits the effects of the invention. These pigments may be dry ones in the form of powder, granules or bulk, or wet ones in the form of wet cake or slurry.

The quinacridone pigment in the invention can be obtained by preparing a polyphosphoric acid solution containing 23 to 30 weight parts of a known quinacridone pigment, pouring the solution into water to reprecipitate a crude quinacridone pigment, and subjecting the resulting crude quinacridone pigment to heating treatment in the absence of pulverizing media in a polar non-proton solvent.

A known quinacridone pigment is dissolved in a polyphosphoric acid solution to obtain a polyphosphoric acid solution containing 23 to 30 weight parts of a known quinacridone pigment. A polyphosphoric acid solution containing a quinacridone pigment in an amount as described above is stirred while heating, whereby a slight amount of impurities, which serve as a crystal growth inhibiting substance, can be contained in the crude quinacridone pigment. A quinacridone pigment is added in a polyphosphoric acid solution at a temperature of 80 to 130° C., and stirred for one to ten hours while heating, whereby a polyphosphoric acid solution containing a quinacridone pigment can be prepared. The polyphosphoric acid solution containing a quinacridone pigment as described above can be also a reaction solution prepared by a method in which for example, 2,5-dianilinoterephthalic acid is subjected to cyclization reaction in a polyphosphoric acid solution. This method is preferred in that the above crystal growth inhibiting substance is easily produced.

The above reprecipitation can be carried out by pouring the quinacridone pigment-containing polyphosphoric acid solution as described above into an excessive amount of water or a liquid medium such as an inorganic acid solution. For example, one weight part of the quinacridone pigment-containing polyphosphoric acid solution is poured into 3 to 15 weight parts of water or a liquid medium such as an inorganic acid solution. The crystal particles produced by the reprecipitation are filtered off to obtain wet cake containing a crude quinacridone pigment. The resulting crude quinacridone pigment is subjected to heat treatment in a polar non-proton solvent. In the heat treatment, the crude quinacridone pigment is stirred for from 2 to 10 hours at a temperature of from 50 to 200° C. in the polar non-proton solvent. Subsequently, the polar non-proton solvent is removed from the quinacridone pigment-polar non-proton solvent mixture to obtain quinacridone pigment as a solid. The resulting solid is washed, dried and pulverized to obtain the quinacridone pigment having a small size in the invention.

Examples of the polar non-proton solvent include dimethylsulfoxide, N-methyl-2-pyrrolidone, N,N-dimethylformamide, N,N-diethylformamide, and 1,3-dimethyl-2-imidazolidinone. A nitrogen-containing alicyclic organic solvent such as N-methyl-2-pyrrolidone or 1,3-dimethyl-2-imidazolidinone is preferred in view of ease of heat treatment, removability or economic efficiency.

As the quinacridone pigment in the invention, there is for example, C. I. Pigment Red 122 "CROMOPHTAL Jet Magenta DMQ" (produced by Ciba Japan Co., Ltd). This pigment is in the spherical or cubic form, and has a number average primary particle size of from 50 to 100 nm and a specific surface area of from 85 to 95 $m^2/g$. In contrast, known C. I. Pigment Red 122 such as FASTOGEN Super Magenta RTS (produced by Dainippon Ink Chemical Co., Ltd.) has a long axis length of from 150 to 250 nm, which is likely to form an acicular structure, and has a specific surface area of from 65 to 75 $m^2/g$. That is, known C. I. Pigment Red 122, FASTOGEN Super Magenta RTS is different in view of the particle size or the shape from the quinacridone pigment in the invention.

In the invention, the toner comprises a colorant including quinacridone pigment having a number average primary particle size of from 30 to 150 nm and having a ratio of a long axis length to a short axis length of from 1.0 to 2.0, whereby the effects of the invention are exhibited.

Herein, the number average primary particle size, long axis length, short axis length, and long axis length to short axis length ratio of the quinacridone pigment in the invention can be determined employing a transmission electron microscope specifically, as the number average primary particle size of the pigment is defined an average of the Feret's diameters of projected images of arbitrary 100 pigment particles on an electron micrograph of the particles, taken at a 50000× magnification through a transmission electron microscope (TEM). Similarly, the long axis length and short axis length of arbitrary 100 pigment particles in the micrograph are measured and the averages thereof are defined as the long axis length and short axis length of the pigment, respectively. The long axis length herein referred to, when two parallel straight lines tangent to the projected pigment image at two points on the periphery of the projected image are drawn, is defined as a length of the longest straight line segment of straight line segments combining the two points on the periphery of the projected image. The short axis length herein referred to is defined as a length of a straight line segment which is perpendicular to the longest straight line segment and combines two points on the periphery of the projected image through the center of the longest line segment.

The number average primary particle size, long axis length and short axis length of the quinacridone pigment in the invention are measured through a transmission electron microscope, the quinacridone pigment being provided on a carbon grid when the number average primary particle size, long axis length and short axis length of the pigment dispersed in the resin of the toner are determined, toner pieces with toner section obtained by cutting the toner particles are employed. The toner particles are sufficiently dispersed in an acryl resin capable of being cured at ordinary temperature to obtain acryl resin embedded toner particles, followed by curing. The resulting samples are cut into sample pieces having a thickness of 100 nm through a microtome with diamond blades. Thus, the toner pieces with toner section are obtained.

The content of the quinacridone pigment in the invention in the toner is preferably from 1 to 10% by weight, and more preferably from 3 to 7% by weight. The above content range of the quinacridone pigment in the invention in the toner is advantageous since it improves coloring power of the toner and has no adverse effect on charging properties without separation from the toner or adhesion to a carrier of the pigment. When a magenta toner is prepared employing the quinacridone pigment in the invention, other magenta colorants may be added to the toner in addition to the quinacridone pigment in the invention. The content of other magenta colorants in the toner is preferably not more than 30% by weight. The content of other magenta colorants in the toner not more than 30% by weight is preferred in exhibiting the effects of the invention.

The present invention provides a full color toner kit comprising plural colored toners, whereby a full color image can be formed. That is, a full color toner image can be formed employing a full color toner kit which is comprised of a magenta toner comprising at least a magenta colorant and a resin, a yellow toner comprising at least a yellow colorant and a resin, a cyan toner comprising at least a cyan colorant and a resin, and a black toner comprising at least a black colorant and a resin, wherein the magenta colorant includes quinacridone pigment having a number average primary particle size of from 30 to 150 nm and having a ratio of a long axis length to a short axis length of from 1.0 to 2.0.

The colorants used in the toner constituting the full color toner kit of the invention will be explained. Examples of the black colorant for the black toner include carbon black, magnetic materials and titanium black. Typical examples of carbon black include Channel Black, Furnace Black, Acetylene Black, Thermal Black and Lamp Black. Typical examples of magnetic materials include ferromagnetic metals such as iron, nickel and cobalt; alloys containing ferromagnetic metals; ferromagnetic compounds such as ferrite and magnetite; and alloys, which do not contain ferromagnetic metals but are subjected to heat treatment to exhibit ferromagnetic property. Examples of the alloys subjected to heat treatment to exhibit ferromagnetic property include alloys called Heusler alloys such as manganese-copper-aluminum and manganese-copper-tin, and chromium dioxide.

Examples of the yellow colorant for the yellow toner include C.I. Solvent Yellow 19, 44, 77, 79, 81, 82, 93, 98, 103, 104, 112, and 162 as a dye; C.I. Pigment Yellow 14, 17, 74, 93, 94, 138, 155, 180 and 185 as a pigment; and a mixture thereof. Of these, C.I. Pigment Yellow 74 is especially preferred.

Examples of the cyan colorant for the cyan toner include C.I. Pigment Blue 15:3.

The number average primary particle size of these colorants dispersed in the toner is preferably from 10 to 200 nm, although it differs due to kinds of the colorants. This number average primary particle size can be calculated from the transmission electron microscope photograph of the colorants in the same manner as the quinacridone pigment in the invention as described above.

The content of these colorants in the toner is preferably from 1 to 10 weight %, and more preferably from 3 to 7 weight %. The above content range of these colorants in the toner is advantageous since it improves coloring power of the toner and has no adverse effect on charging properties without separation from the toner or adhesion to a carrier of the colorants.

Next, the particle diameter of the toner of the invention will be explained.

It is preferred that the toner of the invention has a volume-based median diameter (also denoted simply as D50v) of from 3 to 8 μm. The volume-based median diameter falling within the foregoing region can provide a fine dot image faithfully reproduced, for example, at a level of 1200 dpi (dpi represents the number of dots per inch or 2.54 cm).

One object of the invention is to provide the toner of the invention capable of faithfully carrying out a color reproduction of a photographic image. Such a minute particle size level that the volume-based median diameter falls within the range as described above lessens the size of the dots constituting a photographic image, and makes it possible to obtain a photographic image with precision which is identical to or higher than a printed image. Specifically, in on-demand printing, in which orders for several hundreds to several thousands sets are received, high image quality prints with high-precision photographic images can be delivered to a user.

The volume-based median diameter (D50v) of toner particles can be determined using Multisizer 3 (produced by Beckmann Coulter Co.), connected to a computer system for data processing.

The measurement procedure is as follows: 0.02 g of toner are added to 20 ml of a surfactant-containing solution (for example, a surfactant-containing solution obtained by diluting a surfactant-containing neutral detergent with pure water by a factor of 10) and subjected to ultrasonic dispersion to prepare a toner dispersion. Using a pipette, the toner dispersion is poured into a beaker having ISOTON II (produced by Beckman Coulter Co.) within a sample stand, until reaching a measurement concentration of 5 to 10%. The measurement count was set to 2,500 to perform measurement. The aperture diameter of Multisizer 3 is 50 μm.

The toner of the invention has a coefficient of variation (CV value) in the volume-based particle size distribution of preferably from 2 to 21%, and more preferably from 5 to 15%.

The coefficient of variation (CV value) in the volume-based particle size distribution represents a dispersion degree of toner particle size, in terms of volume and defined by the following formula:

$$CV\text{ value }(\%)=(\text{standard deviation in the volume-based particle size distribution})\times 100/\{\text{median diameter }(D50v)\text{ in the volume-based particle size distribution}\}$$

A lower value of CV indicates a sharper particle size distribution, and means that the particle size tends to be uniform. Uniform particle size enables more precise reproduction of fine-dot images or fine lines, which is required in digital image formation. Printing a photographic image with uniform-sized toner particles results in photographic images of high image quality at a level equivalent to or higher than an image prepared by printing ink.

The toner of the invention has a softening point (Tsp) of preferably from 70 to 110° C., and more preferably 70 to 100° C. Colorants used in the toner of the invention are stable and do not cause any change in the spectrum even when heat is applied. A softening point falling with the foregoing range can reduce effects of heat applied to the toner on fixing. Accordingly, image formation is performed without relying on a colorant, so that a broad stable color reproduction is expected.

A toner with a softening point falling within the foregoing range enables fixing a toner image at a temperature lower than the prior art, rendering it feasible to perform image formation at reduced power consumption and friendly to environments.

The softening point of toner can be controlled by the following methods, singly or in combination thereof.

(1) the kind or the composition of monomer used for resin formation is adjusted;

(2) the molecular weight of a resin is controlled by the kind or the amount of a chain-transfer agent;

(3) the kind or amount of a wax is controlled.

The softening point of a toner may be measured by using, for example, Flow Tester CFT-800 (produced by Shimazu Seisakusho Co., Ltd.). Specifically, a sample which is molded to a 10 mm high column, is compressed by a plunger at a load of $1.96\times10^6$ Pa while heating at a temperature rising rate of 6° C./min, and extruded from a nozzle with a length of 1 mm and a diameter of 1 mm, whereby a curve (softening flow curve) between plunger-drop and temperature is drawn. The temperature at which flowing-out is initiated is defined as a melt-initiation temperature, and the temperature corresponding to a 5 mm drop is defined as a softening temperature.

Next, a method of preparing the toner of the invention will be explained.

The toner of the invention is comprised of particles (hereinafter also referred to as colored particles) containing at least a resin and a colorant. The toner of the invention can be prepared according a conventional toner preparing method, which is not specifically limited. That is, the toner can be prepared applying a so-called pulverizing method, in which toner is prepared through kneading, pulverizing and classification, or a so-called polymerization toner preparation method in which a polymerizable monomer is polymerized and at the same time particle formation is carried out while controlling the shape or size of the particles (for example, an emulsion polymerization method, a suspension polymerization method or a polyester elongation method).

When the toner of the invention is prepared through a pulverizing method, kneading is preferably performed at a temperature of not more than 130° C. When a mixture is kneaded at a temperature exceeding 130° C., heat applied to the mixture tends to change the aggregation state of a colorant in the mixture, rendering it difficult to maintain uniform aggregation of the colorant. There is problem in that variation in the aggregation state causes variations in color tone of the prepared toner, resulting in color contamination.

Next, resin or wax constituting the toner of the invention will be explained with reference to typical examples.

A resin usable for the toner of the invention is not specifically limited, and is typically a polymer prepared by polymerization of polymerizable monomers which are called vinyl monomers. A polymer constituting a resin usable in the invention is a polymer prepared by polymerization of at least one polymerizable monomer, which is a polymer prepared by using vinyl monomers singly or in combination.

Typical examples of a polymerizable vinyl monomer will be listed below:

(1) Styrene or Styrene Derivatives:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene;

(2) Methacrylic Acid Ester Derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic Acid Ester Derivatives:

methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate and phenyl acrylate;

(4) Olefins:

ethylene, propylene and isobutylene;

(5) Vinyl Esters:

vinyl propionate, vinyl acetate and vinyl benzoate;

(6) vinyl Ethers:

vinyl methyl ether and vinyl ethyl ether;

(7) Vinyl Ketones:

vinyl methyl ketone, vinyl ethyl ketone and vinyl hexyl ketone;

(8) N-Vinyl Compounds:

N-vinyl carbazole, N-vinyl indole and N-vinyl pyrrolidone;

(9) Others:

vinyl compounds such as vinylnaphthalene and vinylpyridine; acrylic acid or methacrylic acid derivatives such as acrylonitrile, methacrylonitrile and acrylamide.

As the polymerizable vinyl monomer unit constituting the resin used in the toner of the invention, ones having an ionic dissociation group as described later can be used. As the resin used in the toner of the invention is preferably used a resin obtained by polymerization or copolymerization of a monomer having in the side chain an ionic dissociation group such as a carboxyl group, a sulfonic acid group or a phosphoric acid group, i.e., a polymer (copolymer) having an ionic dissociation group such as a carboxyl group, a sulfonic acid group or a phosphoric acid group, whereby dispersion in the resin of the colorant (pigment) used in the invention can be improved. Typical examples of such a monomer will be shown below.

Typical examples of a monomer having a carboxyl group include acrylic acid, methacrylic acid, maleic acid, itaconic acid, cinnamic acid, fumaric acid, monoalkyl maleate, and monoalkyl itaconate. Typical examples of the monomers having a sulfonic acid group include styrene sulfonic acid, allylsulfosuccinic acid, and 2-acrylamido-2-methylpropane sulfonic acid. Typical examples of the monomers having a phosphoric acid group include acid phosphooxyethyl methacrylate.

Further, a cross-linked resin can be prepared using a polyfunctional monomer described below.

Typical examples of the polyfunctional monomer include divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate As the resin used in the invention, there is a polyester resin obtained by polycondensation of an acid anhydride or a polycarboxylic acid having two or more carboxyl groups with a polyhydric alcohol having two or more hydroxyl group. Examples of the acid anhydride or the polycarboxylic acid include an aliphaatic dicarboxylic acid such as oxalic acid, malonic acid, maleic acid, fumaric acid, citraconic acid, itaconic acid, glucuronic acid, succinic acid, adipic acid, sebacic acid, azelaic acid, n-dodecylsuccinic acid or n-dodecenylsuccinic acid; an alicyclic dicarboxylic acid such as hexane dicarboxylic acid; and an aromatic dicarboxylic acid such as phthalic acid, isophthalic acid, or terephthalic acid. Examples of the polycarboxylic acid having three or more carboxylic acid include trimellitic acid, pyromellitic acid and citric acid. These polycarboxylic acids may be used as an admixture of two or more kinds thereof.

Examples of the polyhydric alcohol include an aliphatic diol such as 1,2-propane dial, 1,3-propane dial, 1,4-butane dial, 1,5-pentane diol, 1,6-hexane diol, 1,7-heptane dial, 1,2-octane diol, neopentyl glycol or 1,4-butene diol; an aromatic diol such as an adduct of bisphenol A with alkylene oxide; and a polyol such as glycerin, pentaerythritol, trimethylol propane or sorbitol. These polyhydric alcohols may be used as an admixture of two or more kinds thereof.

The resin content of the toner is preferably from 60 to 95% by weight, and more preferably from 70 to 90% by weight.

The toner of the invention can contain waxes. The waxes usable in the toner of the invention are those known in the art as listed below:

(1) Polyolefin Wax polyethylene wax and polypropylene wax;

(2) Long Chain Hydrocarbon Wax paraffin wax and sasol wax;

(3) Dialkylketone Wax distearylketone;

(4) Ester Wax carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristarate, and distearyl meleate; (5) Amide Wax ethylenediamine dibehenylamide and trimellitic acid tristearylamide.

The melting point of wax is ordinarily 40 to 125° C., preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is in the range of preferably from 1 to 30% by weight, and more preferably from 5 to 20% by weight.

During a process of manufacturing the toner of the invention, the toner may be added with inorganic particles having a number average primary particle size of from 4 to 800 nm or organic particles as an external additive.

Addition of the external additive improves fluidity or electrostatic property of toner and achieves enhanced cleaning ability. The kind of the external additives is not specifically limited, and examples thereof include inorganic particles, organic particles and a lubricant, as described below.

There are usable commonly known inorganic particles and preferred examples thereof include silica, titania, alumina and strontium titanate particles. There may optionally be used inorganic particles which have been subjected to hydrophobilization treatment.

Specific examples of silica particles include R-976, R-974, R-972, R-812 and R-809 which are commercially available from Nippon Aerosil Co., Ltd.; HVK-2150 and H-200 which are commercially available from Hoechst Co.; and TS-720, TS-530, TS-610, H-5 and MS-5 which are commercially available from Cabot Co.

Examples of titania particles include T-80S and T-604 which are commercially available from Nippon Aerosil Co. Ltd.; MT-100S, MT-100B, MT-500BS, MT-600, MT-60SJA-1 which are commercially available from Teika Co.; TA-300SI, TA-500, TAF-130, TAF-510 and TAF-510T which are commercially available from Fuji Titan Co., Ltd.; and IT-S, IT-OB and IT-OC which are commercially available from Idemitsu Kosan Co., Ltd.

Examples of alumina particles include RFY-C and C-604 which are commercially available from Nippon Aerosil Co., Ltd.; and TTO-55, which is commercially available from Ishihara Sangyo Co., Ltd.

As the organic particles, spherical organic particles having a number-average primary particle size of 10 to 2000 nm are usable. Specifically, there is usable a homopolymer or copolymer of styrene or methyl methacrylate.

Lubricants such as a metal salt of a higher fatty acid can be used in order to achieve enhanced cleaning ability or transferability. Examples of the metal salt of the higher fatty acid include a zinc, copper, magnesium or calcium salt of stearic acid; a zinc, manganese, iron, copper or magnesium salt of oleic acid; a zinc, copper, magnesium or calcium salt of palmitic acid; a zinc or calcium salt of linolic acid; and a zinc or calcium salt of ricinolic acid.

The content of such an external additive or lubricant in the toner is preferably from 0.1 to 10.0% by weight. Addition of the external additive or lubricant can be conducted using various known mixing devices such as a turbuler mixer, a Henschel mixer, a Nauter mixer and a V-shape mixer.

The toner of the invention is usable as a two-component developer comprised of a carrier and a toner or as a nonmagnetic single-component developer comprised of a toner alone.

The use of the toner of the invention as a two-component developer enables full-color printing by using a tandem system image formation apparatus, as described later.

As a carrier which is magnetic particles used in a two-component developer, there can be used known materials, e.g., metals such as iron, ferrite and magnetite and alloys of the foregoing metals and a metal such as aluminum or lead. Of these, ferrite particles are preferred. The volume-average particle size of a carrier is preferably from 15 to 100 μm, and more preferably from 25 to 80 μm.

When image formation is carried out employing a nonmagnetic single-component developer without a carrier, the toner is charged by being rubbed or pressed onto the surface of a charging member or a developing roller. Image formation employing a nonmagnetic single-component development system can simplify the structure of a developing device, resulting in advantages of manufacturing a compact image formation apparatus. Therefore, when the toner of the invention is employed as a single-component developer, a full-color printing can be conducted through a compact color printer, making it feasible to prepare full-color prints of excellent color reproduction even in a space-limited working environment.

Next, an image formation method employing the toner of the invention will be explained. Firstly, an image formation method employing the toner of the invention as a two-component developer will be explained.

FIG. 1 is a schematic view of one example of an image formation apparatus in which the toner of the invention is usable as a two-component developer.

In FIG. 1, 1Y, 1M, 1C and 1K each designate a photoreceptor; 4Y, 4M, 4C and 4K each designate a developing device (a developing means); 5Y, 5M, 5C and 5K each designate a primary transfer roller as a primary transfer means; 5A designates a secondary transfer roller as a secondary transfer means; 6Y, 6M, 6C and 6K each designate a cleaning means; the numeral 7 designates an intermediate transfer unit; the numeral 24 designates a thermal roll fixing device; and the numeral 70 designates an intermediate transfer material.

This image formation apparatus is called a tandem color image formation apparatus, which is composed of a housing 8 comprising plural image formation sections 10Y, 10M, 10C and 10B and an endless belt intermediate transfer material unit 7 as a transfer section, a paper feeding and conveying means 21 to convey recording member P, and a heat roll fixing device 24 as a fixing means. A reading device SC for reading an original is disposed in the upper section of the image formation apparatus body A. The housing 8 is disposed in the image formation apparatus body A so that it can be pulled out from the image formation apparatus body A through supporting rails 82L and 82R.

Image formation section 10Y to form a yellow image as one of a different color toner image formed on the respective photoreceptors comprises a drum-shaped photoreceptor 1Y as a first photoreceptor and disposed around the photoreceptor 1Y, a charging means 2Y, an exposure means 3Y, a developing means 4Y, a primary transfer roller 5Y as a primary transfer means and a cleaning means 6Y. Image formation section 10M to form a magenta image as one of another different color toner image comprises a drum-shaped photoreceptor 1M as a first photoreceptor and disposed around the photoreceptor 1M, a charging means 2M, an exposure means 3M, a developing means 4M, a primary transfer roller 5M as a primary transfer means and a cleaning means 6M. Image formation section 10C to form a magenta image as one of still another different color toner image comprises a drum-shaped photoreceptor 1C as a first photoreceptor and disposed around the photoreceptor 1C, a charging means 2C, an exposure means 3C, a developing means 4C, a primary transfer roller 5C as a primary transfer means and a cleaning means 6C.

Image formation section 10K to form a black image as one of still further another different color toner image comprises a drum-shaped photoreceptor 1K as a first photoreceptor and disposed around the photoreceptor 1K, a charging means 2K, an exposure means 3K, a developing means 4K, a primary transfer roller 5K as a primary transfer means and a cleaning means 6K.

An endless belt intermediate transfer unit 7, which is turned by plural rollers 71, 72, 73, 74, 76 and 77, comprises an endless belt intermediate transfer material 70 as a second image carrier in the endless belt form, which is pivotably supported.

The individual color images formed in image formation sections 10Y, 10M, 10C and 10K are successively transferred onto the rotating endless belt intermediate transfer material 70 by primary transfer rollers 5Y, 5M, 5C and 5K, respectively, to form a composite color image. Recording member P such as paper or the like as a transfer material housed in paper feed cassette 20 is fed by a paper feed and conveyance means 21 and conveyed to a secondary transfer roller 5A through plural intermediate rollers 22A, 22B, 22C and 22D and a resist roller 23, where color images are transferred together on recording member P. The recording member P with the transferred color images is fixed by a heat-roll type fixing device 24, nipped by a paper discharge roller 25, and put onto a paper discharge tray 26 outside a machine.

After a color image is transferred onto recording member P by a secondary transfer roller 5A, any residual toner which remains on the endless belt intermediate transfer material 70 from which the recording member P is separated is removed by a cleaning means 6A.

During image formation, the primary transfer roller 5K is always in contact with the photoreceptor 1K. Other primary rollers 5Y, 5M and 5C are brought into contact with the photoreceptors 1Y, 1M and 1C, respectively, only at the time when color images are formed on the photoreceptors 1Y, 1M and 1C.

The secondary transfer roller 5A is brought into contact with the endless belt intermediate transfer material 70 only when secondary transfer to recording material P is carried out.

Thus, toner images are formed on photoreceptors 1Y, 1M, 1C and 1K, through electrostatic-charging, exposure and development. The resulting toner images having a different color are superimposed on the endless belt intermediate transfer material 70, transferred together onto recording member P and fixed by compression and heating in the heat-roll type fixing device 24. After completion of transferring a toner image to recording member P, any toner remained on the photoreceptors 1Y, 1M, 1C and 1K is removed by cleaning device 6A, whereby the intermediate transfer material 70 is cleaned, and then goes into the foregoing cycle of electrostatic-charging, exposure and development to perform the subsequent image formation.

When the toner of the invention is used as a non-magnetic single-component developer for image formation, the two-component developing means are changed to a nonmagnetic single-component developing means.

The fixing method is not specifically limited, and may be any fixing method. There are, for example, a method employing a heat roller and a pressure roller, a method employing a heat roller and a pressure belt, a method employing a heat belt and a pressure roller, and a method employing a heat belt and a pressure belt. As heating methods, any known heating methods such as a method employing a halogen lamp and a method employing IH may be used.

EXAMPLES

The embodiments of the invention will be explained employing examples, but the invention is by no means limited to these.

I. Preparation of Quinacridone Pigment (Preparation of Quinacridone Pigment 1)

A mixture of 108 weight parts of an aqueous 85% phosphoric acid solution and 162 weight parts of phosphoric acid anhydride was stirred for 20 minutes into a reaction vessel with a stirrer to obtain 270 weight parts of polyphosphoric acid with a phosphoric acid anhydride content of 84.6%. The resulting reaction mixture was further added with 100 weight parts of 2,5-dianilinoterephthalic acid, and stirred at 125° C. for 3 hours to obtain a polyphosphoric acid solution containing 24.4% of quinacridone pigment, The resulting polyphosphoric acid solution was poured into 1500 weight parts of 0° C. water in a vessel with a stirrer with vigorous stirring, and further stirred for additional 30 minutes to obtain precipitates. The resulting precipitates were filtered off, and washed with water to obtain 290 weight parts of crude unsubstituted quinacridone pigment wet cake (with a solid content of 30%). Into anther reaction vessel with a stirrer were placed 290 weight parts of the crude unsubstituted quinacridone pigment wet cake obtained above, 520 weight parts of N-methyl-2-pyrrolidone and 150 weight parts of water, and stirred at 90° C. for 7 hours. Thereafter, the resulting reaction mixture was cooled to room temperature, and the resulting precipitates were filtered off, washed with hot water, dried and pulverized. Thus, 84 weight parts of quinacridone pigment (C.I. Pigment Violet 19) were obtained. This quinacridone pigment was designated as Quinacridone Pigment 1. The number average primary particle size, long axis length, short axis length and a ratio of a long axis length to short axis length of this pigment were 22 nm, 26 nm, 18 nm, and 1.44, respectively.

(Preparation of Quinacridone Pigment 2)

Quinacridone Pigment 2 was prepared in the same manner as Quinacridone Pigment 1, except that the polyphosphoric acid solution was poured into 1500 weight parts of 5° C. water in a vessel with a stirrer with vigorous stirring.

(Preparation of Quinacridone Pigment 3)

Quinacridone Pigment 3 was prepared in the same manner as Quinacridone Pigment 1, except that the polyphosphoric acid solution was poured into 1500 weight parts of 10° C. water in a vessel with a stirrer with vigorous stirring.

(Preparation of Quinacridone Pigment 4)

Quinacridone Pigment 4 was prepared in the same manner as Quinacridone Pigment 1, except that the polyphosphoric acid solution was poured into 1500 weight parts of 15° C. water in a vessel with a stirrer with vigorous stirring.

(Preparation of Quinacridone Pigment 5)

Into a reaction vessel with a stirrer were placed 100 weight parts of an aqueous 85% phosphoric acid solution and 150 weight parts of phosphoric acid anhydride, and stirred for 20 minutes to obtain 250 weight parts of 84.6% polyphosphoric acid in terms of phosphoric acid anhydride. The resulting reaction mixture was further added with 80 weight parts of FASTOGEN Super Magenta RTS produced by Dainippon Ink Chemical Co., Ltd, (dimethylquinacridone, pigment, C.I. Pigment Red 122), and stirred at 140° C. for 3 hours to obtain a polyphosphoric acid solution containing 24.2% of quinacridone pigment. The resulting pqlyphosphoric acid solution was poured into 1500 weight parts of 0° C. water in a vessel with a stirrer with vigorous stirring, and further stirred for additional 30 minutes to obtain precipitates. The resulting precipitates were filtered off, and washed with water to obtain 265 weight parts of crude dimethylguinacridone pigment wet cake (with a solid content of 30%). Into anther reaction vessel with a stirrer were placed 265 weight parts of the crude dimethylguinacridone pigment wet cake as obtained above, 520 weight parts of N-methyl-2-pyrrolidone and 150 weight parts of water, and stirred at 90° C. for 7 hours. Thereafter, the resulting reaction mixture was cooled to room temperature, and the resulting precipitates were filtered off, washed with hot water, dried and pulverized. Thus, 77 weight parts of dimethylquinacridone pigment were obtained. This dimethylquinacridone pigment was designated as Quinacridone Pigment 5.

(Preparation of Quinacridone Pigment 6)

A mixture of 70 weight parts of C.I. Pigment Red 122 CROMOPHTAL Jet Magenta DMQ" (produced by Ciba Japan Co., Ltd), 290 weight parts of isobutanol and 380 weight parts of water were stirred at 130° C. for 7 hours in a stirrer Thereafter, the resulting mixture was cooled to room temperature, and the resulting precipitates were filtered off, washed with hot water, dried and pulverized. Thus, Quinacridone Pigment 6 was obtained.

(Preparation of Quinacridone Pigment 7)

A mixture of 108 weight parts of an aqueous 85% phosphoric acid solution and 162 weight parts of phosphoric acid anhydride was stirred for 20 minutes in a reaction vessel with a stirrer to obtain 270 weight parts of polyphosphoric acid with a phosphoric acid anhydride content of 84.6%. The resulting reaction mixture was further added with 95 weight parts of 2,5-dianilinoterephthalic acid and 5 weight parts of Permanent Red FGR02 produced by Clariant Japan Co., Ltd., (dimethylquinacridone pigments C.I. Pigment Red 122), and stirred at 125° C. for 3 hours to obtain a polyphosphoric acid solution containing 24.4% of quinacridone pigment. The resulting polyphosphoric acid solution was poured into 1500 weight parts of 15° C. water in a vessel with a stirrer with vigorous stirring, and further stirred for additional 30 minutes to obtain precipitates. The resulting precipitates were filtered off, and washed with water to obtain 290 weight parts of crude quinacridone pigment wet cake (with a solid content of 30%). Into anther reaction vessel with a stirrer were placed 290 weight parts of the crude quinacridone pigment wet cake as obtained above, 550. weight parts of N-methyl-2-pyrrolidone and 120 weight parts of water, and stirred at 100° C. for 7 hours. Thereafter, the resulting reaction mixture was cooled to room temperature, and the resulting precipitates were filtered off, washed with hot water, dried and pulverized. Thus, 85 weight parts of Quinacridone Pigment 7 were obtained.

(Preparation of Quinacridone Pigment 8)

A mixture of 70 weight parts of C.I. Pigment Red 122 FASTOGEN Super Magenta RE-25 (produced by Dainippon Ink Chemical Co., Ltd.), 290 weight parts of isobutanol and 380 weight parts of water were stirred at 130° C. for 7 hours in a stirrer. Thereafter, the resulting mixture was cooled to room temperature, and the resulting precipitates were filtered off, washed with hot water, dried and pulverized. Thus, Quinacridone Pigment 8 was obtained.

(Preparation of Quinacridone Pigment 9)

Quinacridone Pigment 9 was prepared in the same manner as Quinacridone Pigment 7, except that the polyphosphoric acid solution was poured into 1500 weight parts of 20° C. water in a vessel with a stirrer with vigorous stirring.

(Preparation of Quinacridone Pigment 10)

Quinacridone Pigment 10 was prepared in the same manner as Quinacridone Pigment 7, except that the polyphosphoric acid solution was poured into 1500 weight parts of 20° C. water in a vessel with a stirrer with vigorous stirring.

(Preparation of Quinacridone Pigment 11)

Quinacridone Pigment 11 was prepared in the same manner as Quinacridone Pigment 7, except that the polyphosphoric acid solution was poured into 1500 weight parts of 35° C. water in a vessel with a stirrer with vigorous stirring.

(Preparation of Quinacridone Pigment 12)

A mixture of 120 weight parts of an aqueous 85% phosphoric acid solution and 180 weight parts of phosphoric acid anhydride was stirred for 20 minutes into a reaction vessel with a stirrer to obtain 300 weight parts of polyphosphoric acid with a phosphoric acid anhydride content of 84.6%. The resulting reaction mixture was further added with 100 weight parts of 2,5-dianilinoterephthalic acid, and stirred at 125° C. for 3 hours to obtain a polyphosphoric acid solution containing 22.5% of quinacridone pigment. The resulting polyphosphoric acid solution was poured into 1500 weight parts of 15° C. water in a vessel with a stirrer with vigorous stirring, and further stirred for additional 30 minutes to obtain precipitates. The resulting precipitates were filtered off, and washed with water to obtain 290 weight parts of crude unsubstituted quinacridone pigment wet cake (with a solid content of 30%). Into another reaction vessel with a stirrer were placed 290 weight parts of the crude unsubstituted quinacridone pigment wet cake obtained above, 290 weight parts of isobutanol, and 380 weight parts of water, and stirred at 130° C. for 7 hours. Thereafter, the resulting reaction mixture was cooled to room temperature, and the resulting precipitates were filtered off, washed with hot water, dried and pulverized. Thus, 84 weight parts of quinacridone pigment 12 were obtained.

(Preparation of Quinacridone Pigment 13)

A mixture of 70 weight parts of C.I. Pigment Red 122 FASTOGEN Super Magenta RTS (produced by Dainippon Ink Chemical Co., Ltd.), 290 weight parts of isobutanol and 380 weight parts of water was stirred at 130° C. for 7 hours in a stirrer. Thereafter, the resulting mixture was cooled to room temperature, and the resulting precipitates were filtered off, washed with hot water, dried and pulverized Thus, Quinacridone Pigment 13 was obtained.

The number average primary particle size, long axis length, short axis length and a long axis length to short axis length ratio of each of Quinacridone Pigments 1 through 13 obtained above were collectively shown in Table 1. These values were determined from observation of the transmission electron microscope photograph as described above.

TABLE 1

| Quinacridone Pigment No. | Pigment Chemical structure | (a) | (b) | (c) | (d) |
|---|---|---|---|---|---|
| 1 | C.I. Pigment Violet 19 | 22 | 26 | 18 | 1.44 |
| 2 | " | 32 | 35 | 28 | 1.25 |
| 3 | " | 45 | 49 | 38 | 1.29 |
| 4 | " | 56 | 67 | 42 | 1.60 |
| 5 | C.I. Pigment Red 122 | 78 | 91 | 61 | 1.49 |
| 6 | " | 89 | 91 | 88 | 1.03 |
| 7 | " | 99 | 122 | 76 | 1.61 |
| 8 | " | 119 | 123 | 115 | 1.07 |
| 9 | " | 120 | 152 | 92 | 1.65 |
| 10 | " | 145 | 178 | 93 | 1.91 |
| 11 | " | 160 | 176 | 139 | 1.27 |
| 12 | " | 89 | 140 | 57 | 2.46 |
| 13 | " | 160 | 250 | 111 | 2.25 |

(a) Number Average Primary Particle Size (nm)
(b) Long Axis Length (nm)
(c) Short Axis Length (nm)
(d) Long Axis Length to Short Axis Length Ratio II. Preparation of Developer (Preparation of Magenta Toner via Kneading-Pulverizing Method)

The toner composition described below was placed in a HENSCHEL MIXER (produced by Mitsui-Miike Kogyo Co., Ltd.) and mixed with stirring at a blade-circumferential speed of 25 m/sec for 5 min.

| | |
|---|---|
| Polyester resin (condensation product of bisphenol A-ethylene oxide adduct, terephthalic acid and trimellitic acid) | 100 weight parts |
| Quinacridone Pigment as shown in Table 1 | 5 weight parts |
| Releasing agent (Pentaerythritol tetrastearate) | 6 weight parts |
| Charge controlling agent (boron dibenzylic acid complex) | 1 weight part |

The resulting mixture was kneaded in a biaxial extrusion kneader, roughly pulverized in a hammer mill, further pulverized in a turbo-mill (produced by TURBO KOGYO Co., Ltd.), and subjected to powder classification in an air classifier employing Coanda effect to obtain colored particles having a volume-based median diameter of 5.5 μm.

Next, the following external additives were added to 100 weight parts of the colored particles obtained above, and subjected to external treatment in a HENSCHEL MIXER (produced by Mitsui-Miike Kogyo Co., Ltd.). Thus, Inventive Magenta Toners 1 through 9 and Comparative Magenta Toners 1 through 4 were prepared.

| | |
|---|---|
| Hexamethylsilazane-treated silica (with an average primary particle size of 12 nm) | 0.6 weight parts |
| n-Octylsilane-treated titanium dioxide (with an average primary particle size of 24 nm) | 0.8 weight parts |

The external treatment in the HENSCHEL MIXER was conducted at 35° C. for 15 minutes under condition of a stirring blade circumferential speed of 35 m/sec.

The number of Quinacridone Pigment used in each of Inventive Magenta Toners 1 through 9 and Comparative Magenta Toners 1 through 4, and the number average primary particle size, long axis length, short axis length and a ratio of a long axis length to short axis length of Quinacridone Pigment in each toner are collectively shown in Table 2.

TABLE 2

| Toner No. | Quinacridone Pigment No. used | (a) | (b) | (c) | (d) |
|---|---|---|---|---|---|
| Inventive Magenta Toner 1 | 2 | 33 | 37 | 29 | 1.28 |
| Inventive Magenta Toner 2 | 3 | 47 | 50 | 39 | 1.28 |
| Inventive Magenta Toner 3 | 4 | 55 | 66 | 42 | 1.57 |
| Inventive Magenta Toner 4 | 5 | 76 | 90 | 61 | 1.48 |
| Inventive Magenta Toner 5 | 6 | 88 | 90 | 88 | 1.02 |
| Inventive Magenta Toner 6 | 7 | 89 | 120 | 76 | 1.58 |
| Inventive Magenta Toner 7 | 8 | 97 | 122 | 114 | 1.07 |
| Inventive Magenta Toner 8 | 9 | 119 | 150 | 92 | 1.63 |
| Inventive Magenta Toner 9 | 10 | 121 | 175 | 93 | 1.88 |
| Comparative Magenta Toner 1 | 1 | 22 | 26 | 18 | 1.44 |
| Comparative Magenta Toner 2 | 11 | 160 | 174 | 138 | 1.26 |
| Comparative Magenta Toner 3 | 12 | 88 | 144 | 58 | 2.48 |
| Comparative Magenta Toner 4 | 13 | 167 | 251 | 110 | 2.28 |

(a) Number Average Primary Particle Size (nm)
(b) Long Axis Length (nm)
(c) Short Axis Length (nm)
(d) Long Axis Length to Short Axis Length Ratio (Preparation of Magenta Toner via Emulsion Coagulation Method)

(1) Preparation of Colorant Particle Dispersion

Sodium n-dodecylsulfate of 11.5 weight parts was poured into 160 weight parts of deionized water, and dissolved with stirring to prepare an aqueous surfactant solution. Forty weight parts of Quinacridone Pigment as shown in Table 3 were gradually added to this aqueous surfactant solution and dispersed using CLEAR MIX W-motion CLM-0.8 (produced by M Technique Co.) to obtain Colorant Particle Dispersions 1 through 13.

The number of Quinacridone Pigment used in Colorant Particle Dispersions 1 through 13 is shown in Table 3.

TABLE 3

| Colorant Particle Dispersion No. | Quinacridone Pigment No. |
|---|---|
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 11 | 11 |
| 12 | 12 |
| 13 | 13 |

(2) Preparation of Core Resin Particle 1

Core Resin Particle 1 having a multilayer structure was prepared through a first polymerization, a second polymerization and a third polymerization as described below.

(a) First Polymerization

Into a reaction vessel fitted with a stirrer, a temperature sensor, a condenser and a nitrogen gas-introducing device was placed 4 weight parts of an anionic surfactant represented by the following formula 1 together with 3040 weight parts of deionized water to prepare an aqueous surfactant solution.

$$C_{10}H_{21}(OCH_2CH_2)_2SO_3Na \qquad \text{Formula 1:}$$

A polymerization initiator solution in which 10 weight parts of potassium persulfate (KPS) were dissolved in 400 weight parts of deionized water was added to the foregoing aqueous surfactant solution, and heated to 75° C. Then, a mixed monomer solution comprised of the following compounds was dropwise added to the reaction vessel in 1 hour.

| | |
|---|---|
| Styrene | 532 weight parts |
| n-Butyl acrylate | 200 weight parts |
| Methacrylic acid | 68 weight parts |
| n-Octyl mercaptan | 16.4 weight parts |

After completing addition of the mixed monomer solution, the resulting reaction mixture was heated with stirring at 75° C. for 2 hours to undergo polymerization (first polymerization) to obtain a first resin particle dispersion. The resin particles in the resulting first resin particle dispersion were designated as Resin Particle A1. The weight average molecular weight of the Resin Particle A1 prepared in the first polymerization was 16,500.

(b) Second Polymerization

A mixed monomer solution comprised of the following compounds was introduced into a flask fitted with a stirrer. Successively, 93.8 weight parts of paraffin wax HNP-57 (produced Nippon Seiro Co., Ltd.) as a releasing agent was added thereto and dissolved with heating at 90° C. to prepare a paraffin wax-containing monomer solution.

| | |
|---|---|
| Styrene | 101.1 weight parts |
| n-Butyl acrylate | 62.2 weight parts |
| Methacrylic acid | 12.3 weight parts |
| n-Octyl mercaptan | 1.75 weight parts |

An aqueous surfactant solution was prepared by dissolving 3 weight parts of the above anionic surfactant in 1560 weight parts of deionized water and heated at 98° C. The above-obtained Resin Particle Al in an amount of 32.8 weight parts (in terms of solid) was added to the resulting aqueous surfactant solution, further added with the paraffin wax-containing monomer solution described above, and dispersed for 8 hours in a mechanical stirrer having a circulation path, CLEARMIX (produced by M Technique Co.). Thus, an emulsified particle dispersion containing emulsified particles having a dispersion particle size of 340 nm was prepared.

Subsequently, a polymerization initiator solution in which 6 weight parts of potassium persulfate were dissolved in 200 weight parts of deionized water was added to the emulsified particle dispersion obtained above. The resulting mixture was heated at 98° C. for 12 hours to undergo polymerization (second polymerization) to prepare a second resin particle dispersion. The resin particles in the resulting second resin particle dispersion were designated as Resin Particle A2. The weight average molecular weight of the Resin Particle A2 prepared in the second polymerization was 23,000.

(c) Third Polymerization

A polymerization initiator solution in which 5.45 weight parts of potassium persulfate were dissolved in 220 weight parts of deionized water was added to the second resin particle dispersion obtained above in the second polymerization step and was dropwise added with a monomer mixture solution comprised of the following compounds at a temperature of 80° C. in one hour.

| | |
|---|---|
| Styrene | 293.8 weight parts |
| n-Butyl acrylate | 154.1 weight parts |
| n-Octyl mercaptan | 7.08 weight parts |

After completing addition, the reaction mixture was heated with stirring for additional two 2 hours to undergo polymerization (third polymerization). After completion of polymerization, the resulting mixture was cooled to 28° C. to obtain a third resin particle dispersion. The resin particles in the resulting third resin particle dispersion were designated as Core Resin Particle 1. The weight average molecular weight of the Core Resin Particle 1 in the third resin particle dispersion prepared in the third polymerization was 26,800.

(3) Preparation of Shell Resin Particle 1

A shell resin particle dispersion was prepared in the same manner as in the first polymerization above, except that the mixed monomer solution used in the first polymerization was changed to the following mixed monomer solution. The resin particles in the resulting shell resin particle dispersion were designated as Shell Resin Particle 1.

| | |
|---|---|
| Styrene | 624 weight parts |
| 2-Ethylhexyl acrylate | 120 weight parts |
| Methacrylic acid | 56 weight parts |
| n-Octyl mercaptan | 16.4 weight parts |

(4) Preparation of Magenta Toner

Inventive Magenta Toners 10 through 18 and Comparative magenta Toners 5 through 8 were prepared according to the following procedures.

(a) Formation of Core

The following composition was introduced into a reaction vessel fitted with a stirrer, a temperature sensor, a condenser and a nitrogen gas introducing device and stirred.

| | |
|---|---|
| Core Resin Particle 1 | 420.7 weight parts (in terms of solid) |
| Deionized water | 900 weight parts |
| Colorant particle dispersion (as shown in Table 3) | 200 weight parts |

The resulting mixture was adjusted to 30° C. and added with an aqueous 5 mol/L sodium hydroxide solution to give a pH of 8 to 11.

Subsequently, an aqueous solution in which 2 weight parts of magnesium chloride hexahydrate were dissolved in 1000 weight parts of deionized water was added thereto at 30° C. in 10 minutes. After allowed to stand for 3 minutes, the mixture was heated to 65° C. in 60 minutes to perform coagulation of particles. Using Multisizer 3 (produced by Beckman Coulter Co.), the particle size of the coagulated particles in the mixture was measured, and when the coagulated particles reached a volume-based median diameter of 5.5 μm, the mixture was added with an aqueous solution in which 40.2 weight parts of sodium chloride were dissolved in 1000 weight parts of deionized water to terminate coagulation.

After terminating coagulation, ripening was conducted at 70° C. for one hour to allow fusion to continue, whereby a core dispersion was prepared. The core particles in the core dispersion were designated as Core 1.

The average circularity of the Core I in the core dispersion was 0.912, measured by FPIA 2100 (produced by SISMECS Co. Ltd.).

(b) Formation of Shell

Subsequently, 96 weight parts (in terms of solid) of Shell Resin Particle 1 were added to the above-obtained core dispersion maintained at 65° C., and an aqueous solution, in which 2 weight parts of magnesium chloride hexahydrate were dissolved in 1000 weight parts of deionized water, was further added thereto in 10 minutes. The resulting mixture was heated to 70° C. and stirred for 1 hour. Thus, the Shell Resin Particle 1 was fusion-adhered onto the surface of the Core 1 and then ripening was carried out at 75° C. for 20 minutes to form a shell.

Thereafter an aqueous solution in which 40.2 weight parts of sodium chloride were dissolved in 1000 weight parts was added to terminate shell formation. The reaction mixture Was cooled to 30° C. at a cooling rate of 8° C./minute, and filtered off to obtain colored particles. The colored particles were repeatedly washed with 45° C. deionized water, and dried with 40° C. hot air. Thus, Colored Particles 10 through 18 and Comparative Colored Particles 5 through 8, each having a shell on the core surface, were prepared.

(c) External Addition Treatment

Subsequently, 100 weight parts of each of the Colored Particles 10 through 18 and Comparative Colored Particles 5 through 8 were added with the following external additives and subjected to external addition treatment with stirring in a HENSCHEL MIXER (produced by Mitsui-Miike Kogyo Co., Ltd.) to prepare Inventive Magenta Toners 10 through 18 and Comparative Magenta Toners 5 through 8, respectively.

| | |
|---|---|
| Hexamethylsilazane-treated silica (average primary particle size of 12 nm) | 0.6 weight parts |
| n-Octylsilane-treated titanium oxide (average primary particle size of 24 nm) | 0.8 weight parts |

The external treatment in a HENSCHEL MIXER was conducted at 35° C. for 15 minutes under condition of a stirring blade circumferential speed of 35 m/second.

The colorant particle dispersion used in each of the toners obtained above is shown in Table 4.

The number of quinacridone pigment and the colorant particle dispersion used for preparation of each toner, and the number average primary particle size, long axis length, short axis length and a ratio of a long axis length to short axis length of Quinacridone Pigment in each toner were collectively shown in Table 4.

TABLE 4

| Toner No. | (i) | (ii) | (a) | (b) | (c) | (d) |
|---|---|---|---|---|---|---|
| Inventive Magenta Toner 10 | 2 | 2 | 30 | 37 | 29 | 1.28 |
| Inventive Magenta Toner 11 | 3 | 3 | 42 | 50 | 39 | 1.28 |
| Inventive Magenta Toner 12 | 4 | 4 | 53 | 66 | 42 | 1.57 |
| Inventive Magenta Toner 13 | 5 | 5 | 76 | 90 | 61 | 1.48 |
| Inventive Magenta Toner 14 | 6 | 6 | 88 | 90 | 88 | 1.02 |
| Inventive Magenta Toner 15 | 7 | 7 | 98 | 120 | 76 | 1.58 |
| Inventive Magenta Toner 16 | 8 | 8 | 118 | 122 | 114 | 1.07 |
| Inventive Magenta Toner 17 | 9 | 9 | 119 | 150 | 92 | 1.63 |
| Inventive Magenta Toner 18 | 10 | 10 | 143 | 175 | 93 | 1.88 |
| Comparative Magenta Toner 1 | 1 | 1 | 21 | 26 | 18 | 1.44 |
| Comparative Magenta Toner 11 | 11 | 11 | 159 | 174 | 138 | 1.26 |
| Comparative Magenta Toner 12 | 12 | 12 | 87 | 144 | 58 | 2.48 |
| Comparative Magenta Toner 13 | 13 | 13 | 159 | 251 | 110 | 2.28 |

(i) Colorant Particle Dispersion No.
(ii) Quinacridone Pigment No.
(a) Number Average Primary Particle Size (nm)
(b) Long Axis Length (nm)
(c) Short Axis Length (nm)
(d) Long Axis Length to Short Axis Length Ratio (Preparation of Another Color Toner)

(Preparation of Yellow Toner 1)

Yellow Toner 1 was prepared in the same manner as Inventive Magenta Toner 5 above, except that C.I. Pigment Yellow 74 was used instead of Quinacridone Pigment 6.

(Preparation of Yellow Toner 2)

Yellow Toner 2 was prepared in the same manner as Inventive Magenta Toner 13 above, except that C.I. Pigment Yellow 74 was used instead of Quinacridone Pigment 5.

(Preparation of Cyan Toner 1)

Cyan Toner 1 was prepared in the same manner as Inventive Magenta Toner 5 above, except that C.I. Pigment Blue 15:3 Was used instead of Quinacridone Pigment 6.

(Preparation of Cyan Toner 2)

Cyan Toner 2 was prepared in the same manner as Inventive Magenta Toner 13 above, except that C.I. Pigment Blue 15:3 was used instead of Quinacridone Pigment 5.

(Preparation of Black Toner 1)

Black Toner 1 was prepared in the same manner as Inventive magenta Toner 5 above, except that carbon black MOGUL L was used instead of Quinacridone Pigment 6.

(Preparation of Black Toner 2)

Black Toner 2 was prepared in the same manner as Inventive Magenta Toner 13 above, except that carbon black MOGUL L was used instead of Quinacridone Pigment 5.

(Preparation of Developers)

Each of Inventive Magenta Toners 1 through 18 and Comparative Magenta Toners 1 through 8, Yellow Toners 1 and 2, Cyan Toners 1 and 2, and Black Toners 1 and 2 was mixed with ferrite carrier covered with methyl methacrylate-cyclohexyl methacrylate copolymer resin having a volume-based median diameter of 50 μm to prepare Magenta Developers 1 through 18, Comparative Magenta Developers 1 through 8, Yellow Developers 1 and 2, Cyan Developers 1 and 2, and Black Developers 1 and 2, respectively. Each developer had a toner content of 6%.

2. Evaluation

Evaluation was conducted using a commercially available, multi-functional printer, bizhub Pro C500 (produced by Konica Minolta Business Technology Inc.) corresponding to an image formation apparatus of a two-component development system, as illustrated in FIG. 1, in which each of the four developing devices was charged with each of the developers.

A combination of the developers is shown in Table 5.

Examples 1 through 18 employ Magenta Developers 1 through 18, and Comparative Examples 1 through 8 employ Comparative Magenta Developers 1 through 8.

TABLE 5

| | Combination of Developers | | | |
|---|---|---|---|---|
| | Magenta Developer No. | C*3) | Y*4) | BL*5) |
| Ex.*1) 1 | Developer 1 | 1 | 1 | 1 |
| Ex. 2 | Developer 2 | 1 | 1 | 1 |
| Ex. 3 | Developer 3 | 1 | 1 | 1 |
| Ex. 4 | Developer 4 | 1 | 1 | 1 |
| Ex. 5 | Developer 5 | 1 | 1 | 1 |
| Ex. 6 | Developer 6 | 1 | 1 | 1 |
| Ex. 7 | Developer 7 | 1 | 1 | 1 |
| Ex. 8 | Developer 8 | 1 | 1 | 1 |
| Ex. 9 | Developer 9 | 1 | 1 | 1 |
| Ex. 10 | Developer 10 | 2 | 2 | 2 |
| Ex. 11 | Developer 11 | 2 | 2 | 2 |
| Ex. 12 | Developer 12 | 2 | 2 | 2 |
| Ex. 13 | Developer 13 | 2 | 2 | 2 |
| Ex. 14 | Developer 14 | 2 | 2 | 2 |
| Ex. 15 | Developer 15 | 2 | 2 | 2 |
| Ex. 16 | Developer 16 | 2 | 2 | 2 |
| Ex. 17 | Developer 17 | 2 | 2 | 2 |
| Ex. 18 | Developer 18 | 2 | 2 | 2 |
| Comp. Ex.*2) 1 | Comparative Developer 1 | 1 | 1 | 1 |
| Comp. Ex. 2 | Comparative Developer 2 | 1 | 1 | 1 |
| Comp. Ex. 3 | Comparative Developer 3 | 1 | 1 | 1 |
| Comp. Ex. 4 | Comparative Developer 4 | 1 | 1 | 1 |
| Comp. Ex. 5 | Comparative Developer 5 | 2 | 2 | 2 |
| Comp. Ex. 6 | Comparative Developer 6 | 2 | 2 | 2 |
| Comp. Ex. 7 | Comparative Developer 7 | 2 | 2 | 2 |
| Comp. Ex. 8 | Comparative Developer 8 | 2 | 2 | 2 |

*1)Ex.: Example
*2)Comp. Ex.: Comparative Example
*3)C: Cyan Developer No.
*4)Y: Yellow Developer No.
*5)BL: Black Developer No.

(Evaluation of Color Reproduction Region of Full Color Image)

Employing the developers obtained above, a 2 cm×2 cm solid image of each of a monochromatic yellow (Y) color, a monochromatic magenta (M) color, a monochromatic cyan (C) color, a monochromatic red (R) color, a monochromatic blue (B) color and a monochromatic green (G) color was formed at 20° C. and at 50% RH. The color gamut thereof was represented on the a*-b* coordinate, and the area (color gamut area) thereof was determined. Color reproduction region of each developer was represented in terms of a value relative to an area composed of color gamut of Y/M/C/R/G/B of Comparative developer 4 being set at 100, and was evaluated. The difference between a solid image having a color gamut area of not less than 115 and a solid image on a computer display is greatly reduced.

(Light Fastness)

A magenta image with a size of 10 cm×10 cm was formed employing Magenta Developers 1 through 18 (Inventive) and Comparative Developers 1 through 8. The resulting magenta image was subjected to exposure of 70,000 lux for 480 hours employing a xenon weather meter XL75. The image reflection densities before and after exposure were measured. Then, the reflection density variation (%) between before and after exposure was determined, and evaluated as a measure of light fastness.

Herein, the reflection density variation (%) before and after exposure is represented by the following formula:

Reflection density variation (%) before and after exposure=(Reflection density before exposure−Reflection density after exposure)×100/Reflection density before exposure The results are shown in Table 6

TABLE 6

| | Evaluation Results | |
|---|---|---|
| | Color Gamut | Reflection Density Variation (%) |
| Ex.*1) 1 | 118 | 1.2 |
| Ex. 2 | 118 | 0.6 |
| Ex. 3 | 117 | 0.8 |
| Ex. 4 | 116 | 0.5 |
| Ex. 5 | 123 | 0.0 |
| Ex. 6 | 117 | 0.1 |
| Ex. 7 | 123 | 0.0 |
| Ex. 8 | 116 | 0.1 |
| Ex. 9 | 116 | 0.1 |
| Ex. 10 | 119 | 1.3 |
| Ex. 11 | 119 | 0.7 |
| Ex. 12 | 118 | 0.5 |
| Ex. 13 | 117 | 0.4 |
| Ex. 14 | 125 | 0.0 |
| Ex. 15 | 117 | 0.1 |
| Ex. 16 | 126 | 0.0 |
| Ex. 17 | 117 | 0.1 |
| Ex. 18 | 117 | 0.1 |
| Comp. Ex.*2) 1 | 119 | 9.1 |
| Comp. Ex. 2 | 100 | 0.2 |
| Comp. Ex. 3 | 102 | 8.6 |
| Comp. Ex. 4 | 100 | 8.7 |
| Comp. Ex. 5 | 119 | 9.0 |
| Comp. Ex. 6 | 100 | 0.3 |
| Comp. Ex. 7 | 102 | 8.6 |
| Comp. Ex. 8 | 100 | 8.7 |

*1)Ex.: Example

*2)Comp. Ex.: Comparative Example

As is apparent from Table 6, Examples 1 through 18 employing Magenta Developers 1 through 18 containing the inventive magenta toner provide increased color gamut area, as compared with Comparative Examples 1 through 8 employing Comparative Magenta Developers 1 through 8 containing the comparative magenta toner. Thus, use of Magenta Developers 1 through 18 containing the inventive magenta toner can increase color gamut area.

It has proved that an image formed employing Magenta Developers 1 through 18 containing the inventive magenta toner has excellent light fastness, as compared with that formed employing Comparative Magenta Developers 1 through 8 containing the comparative magenta toner.

What is claimed is:

1. A magenta for developing an electrostatic image comprising at least a polyester resin, a wax and a magenta colorant, wherein the magenta colorant is a quinacridone pigment having a number average primary particle size of from 30 to 150 nm and having a ratio of a long axis length to a short axis length of from 1.0 to 2.0, and wherein the content of the polyester resin in the toner is from 70 to 95 weight % and the content of the quinacridone pigment in the toner is from 1 to 10 weight %.

2. The toner for developing an electrostatic image of claim 1, wherein the toner has a volume-based median diameter of from 3 to 8 μm.

3. The toner for developing an electrostatic image of claim 1, wherein the toner has a coefficient of variation of from 2 to 21% in the volume-based particle size distribution.

4. The toner for developing an electrostatic image of claim 1, wherein the toner has a softening point (Tsp) of from 70 to 110° C.

5. The toner for developing an electrostatic image of claim 1, wherein the resin is a polymer having in the side chain a carboxyl group, a sulfonic acid group or a phosphoric acid group.

6. A full, color toner kit comprised of at least a yellow toner comprising at least a yellow colorant and a resin, a magenta toner comprising at least a magenta colorant, a wax and a polyester resin, a cyan toner comprising at least a cyan colorant and a resin, and a black toner comprising at least a black colorant and a resin, wherein the magenta colorant is a quinacridone pigment having a number average primary particle size of from 30 to 150 nm and having a ratio of a long axis length to a short axis length of from 1.0 to 2.0, and wherein the content of the polyester resin in the magenta toner is from 70 to 95 weight % and the content of the quinacridone pigment in the magenta toner is from 1 to 10 weight %.

7. An image formation method comprising the step of forming an image employing a yellow toner comprising at least a yellow colorant and a resin, a magenta toner comprising at least a magenta colorant, a wax and a polyester resin, a cyan toner comprising at least a cyan colorant and a resin, and a black toner comprising at least a black colorant and a resin, wherein the magenta colorant is a quinacridone pigment having a number average primary particle size of from 30 to 150 nm and having a ratio of a long axis length to a short axis length of from 1.0 to 2.0, and wherein the content of the polyester resin in the magenta toner is from 70 to 95 weight % and the content of the quinacridone pigment in the magenta toner is from 1 to 10 weight %.

8. The magenta toner for developing an electrostatic image of claim 1, wherein the content of the quinacridone pigment in the toner is from 3 to 7 weight %.

9. The magenta toner for developing an electrostatic image of claim 1, wherein the content of the wax in the toner is from 1 to 30 weight %.

10. The magenta toner for developing an electrostatic image of claim 1, wherein the content of the wax in the toner is from 5 to 20 weight %.

* * * * *